US006454547B1

(12) United States Patent
Kohlhaas et al.

(10) Patent No.: US 6,454,547 B1
(45) Date of Patent: Sep. 24, 2002

(54) DELIVERY UNIT

(75) Inventors: Helmut Kohlhaas, Wildeck-Richelsdorf; Dieter Wilhelm, Bebra, both of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/423,261

(22) PCT Filed: Apr. 21, 1998

(86) PCT No.: PCT/EP98/02338

§ 371 (c)(1),
(2), (4) Date: Nov. 13, 1999

(87) PCT Pub. No.: WO98/50701

PCT Pub. Date: Nov. 12, 1998

(51) Int. Cl.[7] ..... F04B 36/04
(52) U.S. Cl. ..... 417/353; 417/423.1
(58) Field of Search ..... 417/355, 353, 417/352, 410.1, 423.1, 423.7

(56) References Cited

U.S. PATENT DOCUMENTS 2,947,467 A * 8/1960 Palmer ..... 417/353
2,976,808 A * 3/1961 Whitehurst ..... 417/353
RE25,569 E * 5/1964 Coron et al. ..... 417/353
4,787,829 A * 11/1988 Miyazaki et al. .... 417/423.4 X
5,542,825 A * 8/1996 Perrillat-Amede et al. ..... 417/423.4
5,772,395 A * 6/1998 Schofield ..... 415/90
6,050,782 A * 4/2000 Lembke ..... 417/205
6,135,098 A * 10/2000 Allen et al. ..... 417/423.1 X
6,210,134 B1 * 4/2001 Miyahara ..... 417/423.14

OTHER PUBLICATIONS

Greene, ed.; Modern Plastics Encyclopedia; Oct.. 1991; McGraw–Hill; vol. 68–No. 11, pp. 79–81.*

* cited by examiner

*Primary Examiner*—Charles G. Freay
(74) *Attorney, Agent, or Firm*—Mayer, Brown, Rowe & Maw

(57) ABSTRACT

A delivery unit which is provided for feeding motor-vehicle fuel has an electric motor (1) with vanes (1) arranged on the lateral surface of a rotor (4). During rotation of the rotor (4), the vanes (11) feed the fuel in a pump channel (19) between the rotor (4) and a stator (3). The delivery unit is thus constructed in a particularly compact manner and is cost-effective to produce.

8 Claims, 1 Drawing Sheet

DELIVERY UNIT

BACKGROUND OF THE INVENTION

1. Field of the Invention

The invention relates to a delivery unit, in particular for feeding fuel or washing liquid in a motor vehicle, having a pump which is driven by an electric motor and has vanes, the electric motor having a rotor and a stator and the vanes being arranged on the rotor and being provided for movement in a fixed pump channel.

2. Description of the Related Art

Such delivery units are frequently used in modern motor vehicles as a fuel, pump or as a washing-liquid-pump for a window-cleaning installation and are thus known. The rotor of the electric motor is of the electric motor is of cylindrical configuration. The vanes are arranged on one of the end sides of the rotor. A housing of the electric motor serves, at the same time, as a housing for the pump and, in its region adjacent to the vanes, forms the pump channel. For the purpose of cooling the electric motor, the liquid fed is then guided through the electric motor between the rotor and a stator. The delivery unit thus comprises a very small number of components and can therefore be assembled cost-effectively.

The disadvantage of the known delivery unit is that it has very large dimensions. For example, as a result of the vanes being arranged on the end side of the rotor, the delivery unit has a particularly long axial extent.

It would be conceivable for the rotor to be of tubular configuration and the vanes to be provided on the inner wall of the rotor. However, this means that the rotor is a complicated component, with the result that it would require particularly high production costs.

The problem on which the invention is based is to configure a delivery unit of the type mentioned in the introduction such that it has the smallest possible dimensions and can be produced particularly cost-effectively.

This problem is solved according to the invention in that the stator forms at least part of the wall of the pump channel.

SUMMARY OF THE INVENTION

This configuration means that the vanes are arranged in a region of the rotor which is located opposite the stator. As a result, the delivery unit according to the invention does not require any pump-housing part designed as a pump channel and therefore has particularly small dimensions. The vanes are arranged on an easily accessible, outer region of the rotor, as a result of which the delivery unit according to the invention can be produced particularly cost-effectively.

In a delivery unit in the case of which the rotor is of cylindrical configuration, it would be possible to arrange, for example, a plurality of individual vanes on the lateral surface of the rotor. However, according to an advantageous development of the invention, the vanes produce particularly low levels of turbulence in the liquid which is to be fed if the vanes are of helical configuration. By virtue of this configuration, the liquid which is to be fed is guided by the vanes in a uniform manner, and thus free of turbulence. This turbulence-free feed is important in the case of hot fuel in particular because the latter tends to form gas bubbles. Gas bubbles in the liquid which is to be fed often result in a vast reduction in the feeding capacity of the delivery pump.

In a delivery unit in the case of which the rotor and the stator are of disk-shaped configuration, the liquid which is to be fed can be fed with particularly low levels of turbulence, according to another advantageous development of the invention, if the vanes are of spiral configuration.

The delivery unit according to the invention has a particularly high feeding capacity, along with particularly small dimensions, if, in relation to the vanes of the rotor, the stator has vanes arranged in the opposite direction.

The vanes have a particularly low weight, and thus a low mass moment of inertia, if the vanes are produced from plastic. This allows the electric motor to have a particularly low output. This results in a further reduction in the dimensions of the delivery unit according to the invention.

In order further to reduce the production costs of the delivery unit according to the invention, it is helpful if the vanes are produced integrally with the rotor or the stator. In the most favorable case, this only results in the production costs of the delivery unit according to the invention being increased to a very slight extent, since the rotor and the stator are cast with a synthetic resin anyway.

The delivery unit according to the invention comprises a particularly small number of components and can thus be assembled cost-effectively if the vanes of the stator are made in a permanent magnet of the stator.

According to another advantageous development of the invention, the vanes have a high level of stability if the vanes have a rectangular cross section.

According to another advantageous development of the invention, the vanes have a particularly low volume, and thus low material costs, if the vanes have a triangular cross section.

The invention allows numerous embodiments. In order to clarify basic principles of the invention further, two of these embodiments are described hereinbelow and illustrated in the drawing, in which:

DETAILED DESCRIPTION OF THE PRESENTLY PREFERRED EMBODIMENTS

Figure 1:
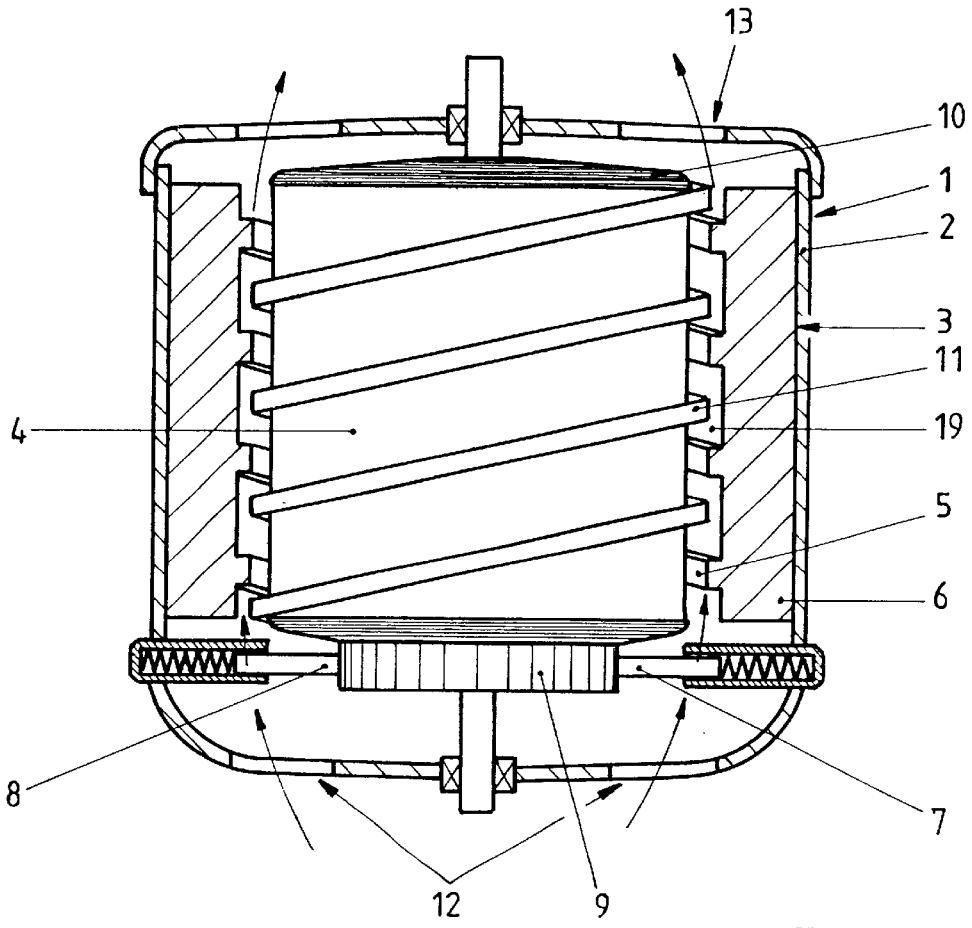
FIG. 1 shows a sectional illustration through a delivery unit according to the invention with a cylindrical rotor.

FIG. 1 shows a delivery unit according to the invention with an electric motor 1. The electric motor 1 has a stator 3, which is arranged in a rotationally fixed manner in a housing 2, and a cylindrical rotor 4, which is mounted rotatably in the housing 2. The stator 3 has an annular permanent magnet 6 which is provided with helical vanes 5 on its inside. Arranged in the housing 2 are carbon brushes 7, 8 which, during rotation of the rotor 4, slide over a commutator 9 and supply the latter with electric current. The rotor 4 has coils 10 in contact with the commutator 9 and, on its lateral surface, has helical vanes 11 arranged in the opposite direction in relation to the vanes 5 of the stator 3. The vanes 5, 11 each have a rectangular cross section.

During rotation of the rotor 4, a liquid which is to be fed is taken in through intake openings 12 arranged in the housing 2 and fed by the vanes 5, 11 between the rotor 4 and the stator 3. The liquid then leaves the housing 2 through outlet openings 13 located opposite the intake openings 12. For clarification purposes, the liquid flow is indicated by arrows in the drawing. The region between the rotor 4 and the stator 3 is thus formed as a pump channel 19.

Figure 2:
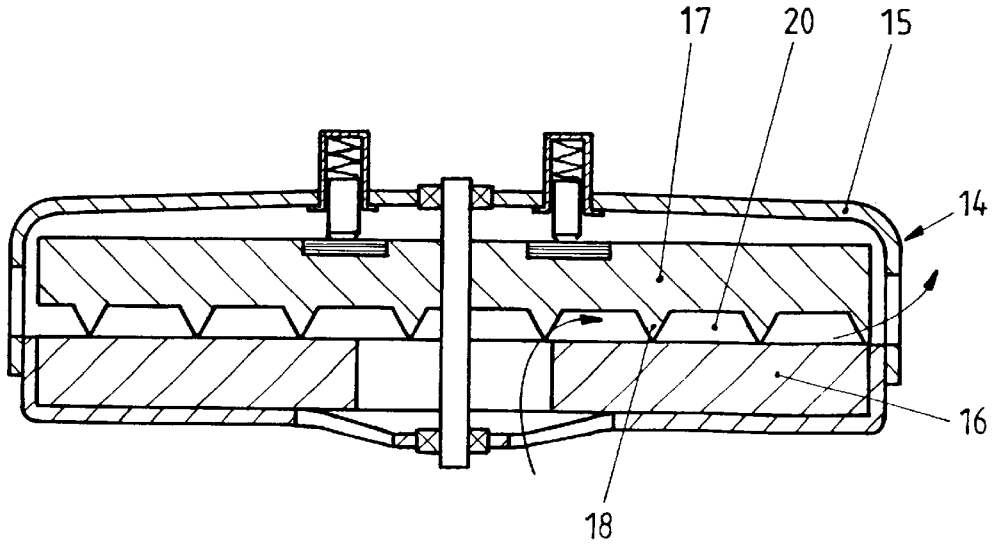
FIG. 2 shows a sectional illustration through a further embodiment of the delivery unit according to the invention with an axially constructed electric motor.

FIG. 2 shows a further embodiment of the delivery unit according to the invention with an axially constructed electric motor 14. The electric motor 14 has a disk-shaped stator 16, which is fastened in a housing 15, and a likewise disk-shaped rotor 17, which is located opposite the stator 16. On its end side which is located opposite the stator 16, the rotor 17 has a spiral vane 18 routed from the center to the radially outer regions of the rotor. During rotation of the rotor 17, a liquid can be fed from a radially inner region of the housing 15 to a radially outer region through a pump channel 20.

What is claimed is:

1. A fluid pump comprising:

an electric motor comprising a rotor and a stator, wherein the rotor has rotor vanes located thereon, wherein the rotor vanes have an outer diameter and are provided for movement in a fixed pump channel, wherein the stator forms at least part of a wall of the pump channel, and further has stator vanes defining an inner diameter of the stator, wherein the outer diameter of the rotor vanes is less than the inner diameter of the stator.

2. The fluid pump as claimed in claim 1 wherein the rotor is of cylindrical configuration and the rotor vanes are of helical configuration.

3. The fluid pump as claimed in claim 1 wherein, in relation to the rotor vanes, the stator vanes are arranged in the opposite direction.

4. The fluid pump as claimed in claim 1, wherein the rotor vanes and stator vanes are comprised of plastic.

5. The fluid pump as claimed in claim 1, wherein the rotor vanes are produced integrally with the rotor.

6. The fluid pump as claimed in claim 1, wherein the stator vanes are formed in a permanent magnet of the stator.

7. The fluid pump as claimed in claim 1, wherein the rotor vanes have a rectangular cross section.

8. The fluid pump as claimed in claim 1, wherein the rotor vanes have a triangular cross section.

* * * * *

UNITED STATES PATENT AND TRADEMARK OFFICE

CERTIFICATE OF CORRECTION

PATENT NO. : 6,454,547 B1 
DATED : September 24, 2002
INVENTOR(S) : Kohlhaas et al.

It is certified that error appears in the above-identified patent and that said Letters Patent is hereby corrected as shown below:

Title page,
Insert the following:
-- [30] Foreign Application Priority Data
May 3, 1997 (DE) ……. 197 18 791.9 --

Signed and Sealed this

Fourth Day of February, 2003

JAMES E. ROGAN
*Director of the United States Patent and Trademark Office*